US005608991A

United States Patent [19]

Yamashita

[11] Patent Number: 5,608,991

[45] Date of Patent: Mar. 11, 1997

[54] FLEXIBLE FORM MEMBER AND METHOD OF FORMING THROUGH HOLE BY MEANS OF THE FORM MEMBER

[76] Inventor: Senji Yamashita, 26-1, Nishiura-cho, Naginotsuji, Yamashina-ku, Kyoto-shi, Kyoto 607, Japan

[21] Appl. No.: 367,270

[22] PCT Filed: Mar. 9, 1994

[86] PCT No.: PCT/JP94/00382

§ 371 Date: Jan. 17, 1995

§ 102(e) Date: Jan. 17, 1995

[87] PCT Pub. No.: WO94/27002

PCT Pub. Date: Nov. 24, 1994

[30] Foreign Application Priority Data

May 18, 1993 [JP] Japan ..... 5-115976

[51] Int. Cl.[6] ..... E04G 11/04; E04H 15/20

[52] U.S. Cl. ..... 52/2.17; 52/2.15; 52/220.8; 52/576

[58] Field of Search ..... 52/2.15, 2.17, 52/220.8, 576, 577; 249/65, 188, 142, 144

[56] References Cited

FOREIGN PATENT DOCUMENTS

| | | |
|---|---|---|
| 60-130846 | 9/1985 | Japan . |
| 63-107654 | 5/1988 | Japan . |
| 4110853 | 9/1992 | Japan . |

*Primary Examiner*—Carl D. Friedman
*Assistant Examiner*—Yvonne Horton-Richardson
*Attorney, Agent, or Firm*—Banner & Witcoff Ltd.

[57] ABSTRACT

A flexible form member in accordance with the invention comprises a hollow-shaped body having a flexibility and openable fluid introducing and discharging means for permitting fluid to be introduced into and discharged from the body. A method of forming a through hole by means of the flexible form member comprises placing the flexible form member as contracted in a desired position between an outer form and an inner form, introducing fluid into the flexible form member to expand it between the outer form and inner form, pouring concrete, removing the forms and contracting the flexible form member after curing of concrete, and removing the flexible form member thus contracted from concrete.

10 Claims, 16 Drawing Sheets

FLEXIBLE FORM MEMBER AND METHOD OF FORMING THROUGH HOLE BY MEANS OF THE FORM MEMBER

FIELD OF THE ART

This invention relates to a flexible form member which is preferably used in constructing new buildings of reinforced concrete, or foundations for buildings of reinforced steel-framed or steel-framed concrete or of wood, and a method of forming a through hole by means of the form member.

In constructing the above-mentioned buildings, it is necessary to form through holes in beams, walls, slabs, foundations, or the like, associated with constructing general facilities or ventilation for the buildings, and then a flexible form member is employed to form such a through hole at the same time concrete is poured.

BACKGROUND ART

Generally, a paper pipe, a steel sheet or a steel pipe has been used as such a conventional flexible form member. That is to say, in a conventional construction method, as shown in FIG. 18, a paper tube c is arranged at a desired position in a condition of being interposed between an outer form a and an inner form b, then concrete is poured into a space between the above-mentioned outer form a and inner form b in order to form slabs, beams, or walls. The outer form a and the inner form b are removed when the concrete has cured, then the above-mentioned paper tube c is removed thereby to form a through hole.

However, a plurality of reinforcements have been arranged over and under the through holes to be formed, as shown in FIG. 18. In order to arrange a paper tube c whose diameter is larger than a pitch between reinforcements d, the paper tube c should be temporarily deformed into flat and inserted into the space between reinforcements d, then it should be arranged to bridge the outer form a and the inner form b while restoring the original shape. Therefore, it takes much labor and time to make an arrangement for forming a plurality of through holes. In addition, the paper tube c may accidentally be set before it has been restored to the original shape, which will cause a problem that the opening of the through hole deforms.

In order to solve the above-mentioned problem, a method can be conceived that the paper tube c is set after only the reinforcement e under the paper tube c has been arranged, then the reinforcement d over the paper tube c is arranged. However, it deteriorates the work efficiency because it prevents work which involves welding or the like from being continuously accomplished. In addition, the paper tube c which has once been set may be pushed by unexpected force which may arise when the reinforcement d over the paper tube c is arranged thereby to change the position where it should be. Thus it prevents from forming a hole which penetrates the concrete at the predetermined position.

It is an object of the present invention to provide a flexible flexible form member which solves the above-mentioned problems.

DISCLOSURE OF THE INVENTION

To accomplish the above-mentioned object the invention has adopted the following structure. The flexible form member in accordance with the invention comprises a hollow-shaped body having a flexibility, and openable fluid introducing and discharging means for permitting fluid to be introduced into and discharged from the body.

The openable fluid introducing and discharging means preferably comprises a tubular passage part which is connected to the body and a cap member which is attached to an outside end of the passage part and able to open. The length of the tubular passage part is not specified, and it may be the same that the body length or may be so short that the cap member locates near the body. It is preferable that the passage part has a check valve at an end near the body side.

The body may also have a connecting part on its surface to connect a fixing member for securing the body. The body preferably comprises a circular wall being cylindrical and an end wall fixed integrally and airtightly on each of ends of the circular wall. The operable fluid introducing and discharging means is preferably provided on at least the circular wall and one of the end walls.

A method of forming a through hole by means of a flexible form member according to the invention comprises the following steps of; to place a flexible form member at a predetermined position between an outer form and an inner form which are for shutting the concrete flow off, the flexible form member comprising a hollow-shaped body having a flexibility and openable fluid introducing and discharging means for permitting fluid to be introduced into and discharged from the body and being contracted by discharging fluid from the body, to introduce the fluid into the body of the flexible form member through the openable fluid introducing and discharging means, to interpose the flexible form member between the inner form and the outer form by expanding the body, to pour concrete into a space between the outer form and the inner form, to remove the inner and outer forms after the curing of concrete, to discharge the fluid out of the body through the openable fluid introducing and discharging means so as to contract the flexible form member, and to remove the flexible form member out of concrete cured.

The flexible form member according to the invention can form a through hole whose bore diameter corresponds to the outside diameter of the body of the flexible form member, if in condition of the body charged with fluid like air, the length of the flexible form member is so set that the flexible form member can be interposed in a predetermined position between the outer form and the inner form for shutting concrete flow off to form a slab, a wall or the like.

More particularly, the body having a flexibility can be contracted by discharging fluid out of the body. Therefore, the body contracted can be placed at a predetermined position between the inner form and the outer form by passing through a narrow space, then fluid such as air is introduced into the body through the openable fluid introducing and discharging means. After that the body expands so as to be interposed between the outer form and the inner form. Then concrete is poured into a space between the outer form and the inner form, and the inner form and outer form are removed when concrete has cured. The surface of the flexible form member which has been touched to the outer form and the inner form will expose to the surface of the concrete structure. A through hole will be formed at the predetermined position of the concrete structure when the flexible form member is discharged fluid from its body.

BEST MODES OF EMBODYING THE INVENTION

Figure 1:
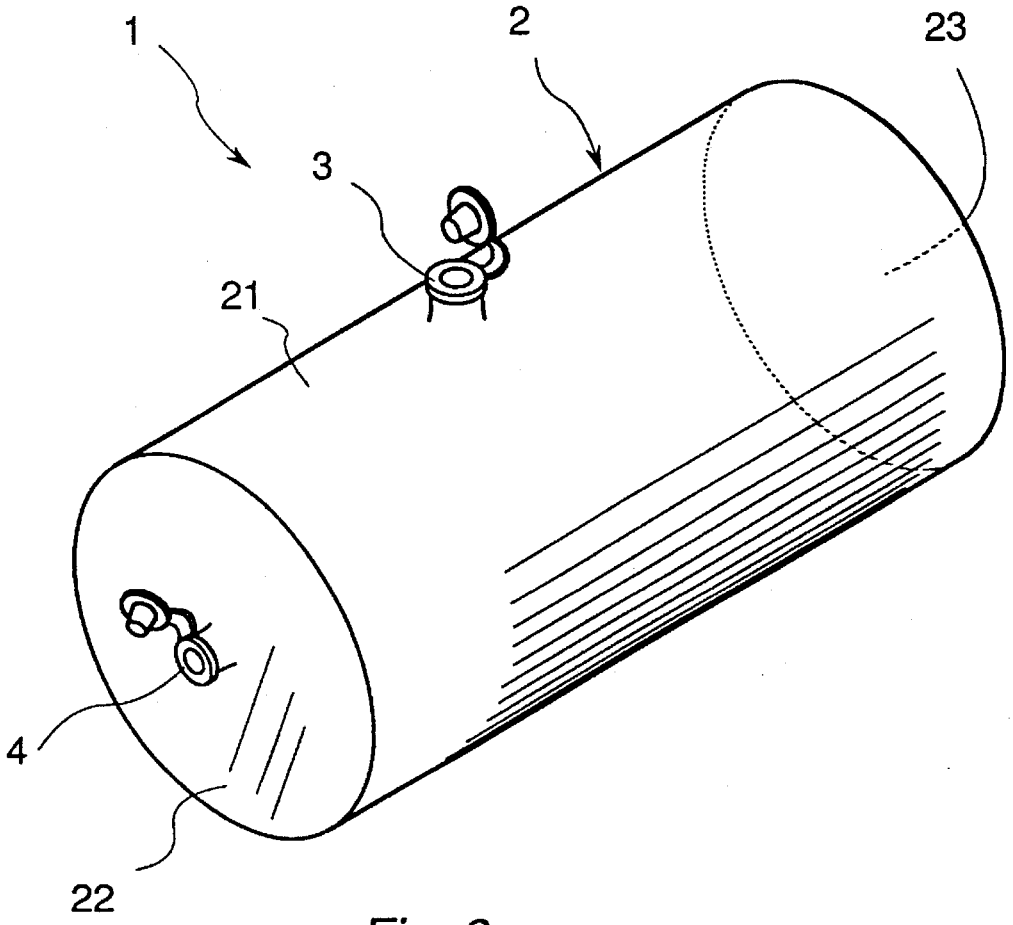
FIG. 1 is a perspective view of a preferred embodiment of this invention.
Figure 2:
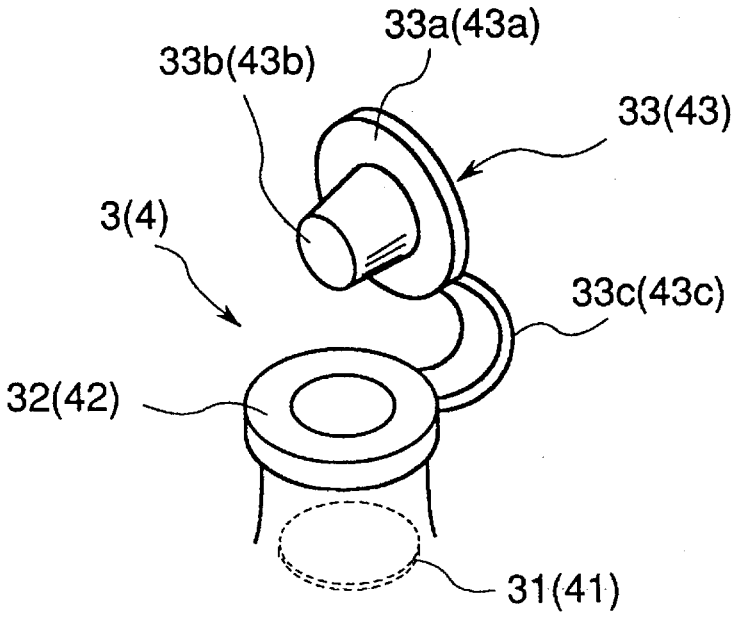
FIG. 2 is an enlarged perspective view of an openable fluid introducing and discharging means in accordance with the preferred embodiment.

An embodiment of the invention will now be described below with reference to FIG. 1 through FIG. 8.

The flexible form member 1 comprises a hollow-shaped body 2 having a flexibility and openable fluid introducing and discharging means 3, 4 for permitting fluid to be introduced into and discharged from the body 2.

More particularly, the body 2 is made of vinyl chloride and formed a hollow cylindrical shape by means of circular wall 21 and end walls 22, 23 which are integrated airtightly by heating. The openable fluid introducing and discharging means 3, 4 are provided in the centers of the circular wall 21 and the end wall 22, respectively. The size of the body 2 varies with the purpose, for example, a standard diameter of approximately 50 mm to 300 mm, and a standard length of approximately 50 mm to 1000 mm. The withstanding pressure will do at approximately 0.6 kg/cm$^2$.

The openable fluid introducing and discharging means 3, 4 comprise tubular passage parts 32, 42 having check valves 31, 41 at the inside end of the passage parts 32, 42 and cap members 33, 43 which are attached to the outside ends of the passage parts 32, 42 able able to open. The check valves 31, 41 and the cap members 33, 42 may be of the same structures as those which are adopted to a rubber ring, a beach ball or the like. To be concrete, each of the check valves 31, 41 comprises a flexible disc which can be bent and restored to the original shape and have the outside diameter being made a little larger than the bore diameter of the passage parts 32, 42. The check valves 31, 41 normally close the passage parts 32, 42 at the body sides of the passage parts 32, 42 and open by means of the pressure when fluid is pressurized and introduced to the passage parts 32, 42. The cap members 33, 43 comprise tapered rods 33*b*, 43*b* at the end of which provided with flanges 33*a*, 43*a*. Sharp ends of the rod 33*b*, 43*b* can fit into the passage parts 32, 42. The flanges 33*a*, 43*a* are made a little larger in diameter than the passage parts 32, 42 for easy operation of opening and attached to the ends of the passage parts 32, 42 through connecting leaves 33*c*, 43*c*. The body 2 can be expanded by filling air A through tubes or the like which are inserted to the passage parts 32, 42 with the cap members 33, 43 released and can be contracted by discharging air A from the body 2 with the check valves 31, 41 open by pinching the body side ends of the passage parts 32, 42. The openable fluid introducing and discharging means 3, 4 are so constructed that the passage parts 32, 42 are buried into the body 2 after the cap members 33, 43 are closed. The surface of the cap members 33, 43 level off the surface of the body 2 when the openable fluid introducing and discharging means 3, 4 are buried into the body 2.

Figure 3:
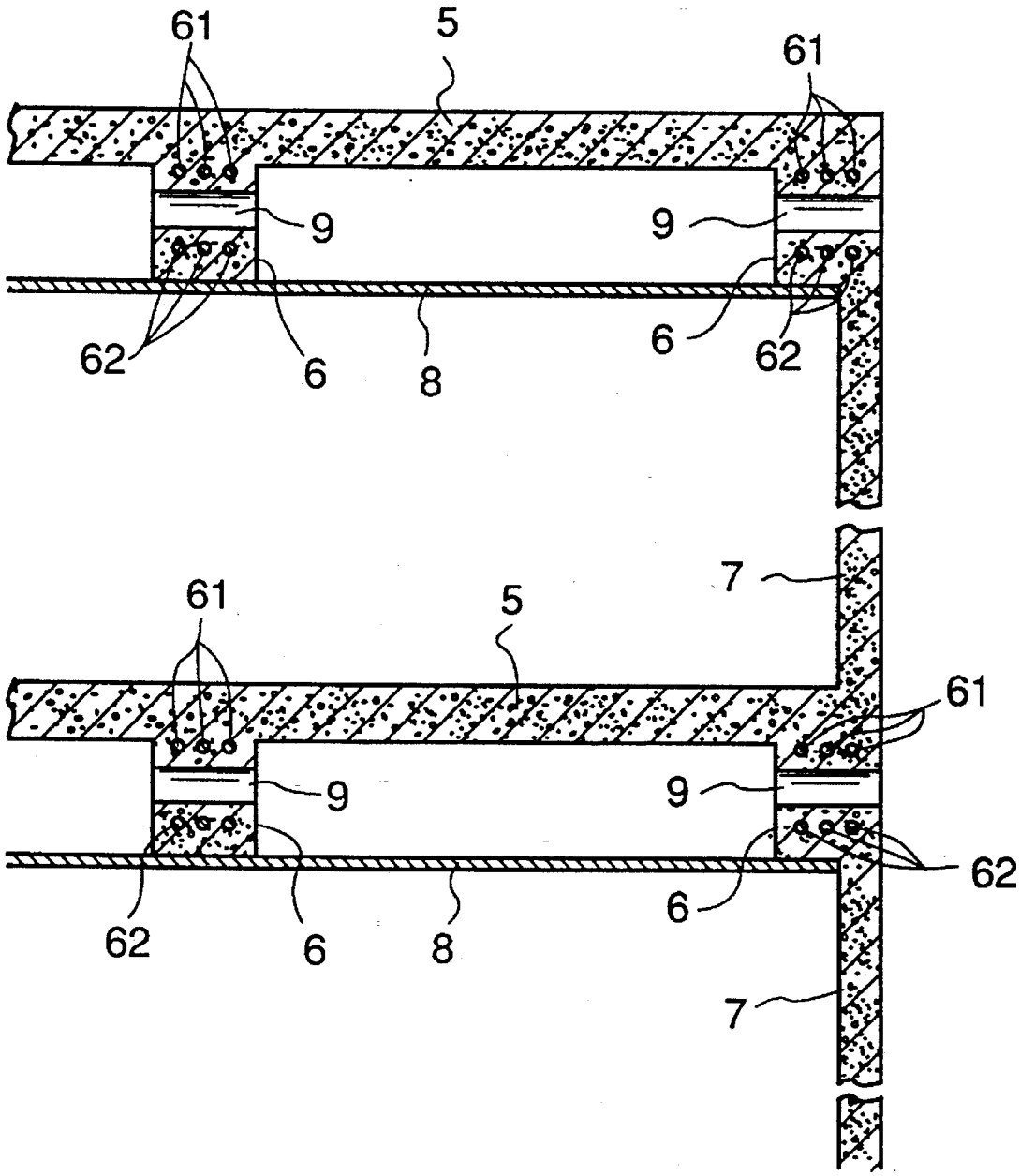
FIG. 3 is a schematic sectional view to explain the usage of the preferred embodiment.

A method of forming a through hole 9 by means of the flexible form member 1 will now be explained with reference to FIG. 3 to FIG. 8. FIG. 3 schematically shows a sectional view of a part of the structure made of reinforced concrete, where 5 indicates a slab, 6 a beam, 7 a wall and 8 a ceiling. In addition, 61 indicates an upper reinforcement and 62 a lower reinforcement. Plurality of reinforcements arranged in other part are omitted to show as considered to be irrelevant to the invention.

Figure 4:
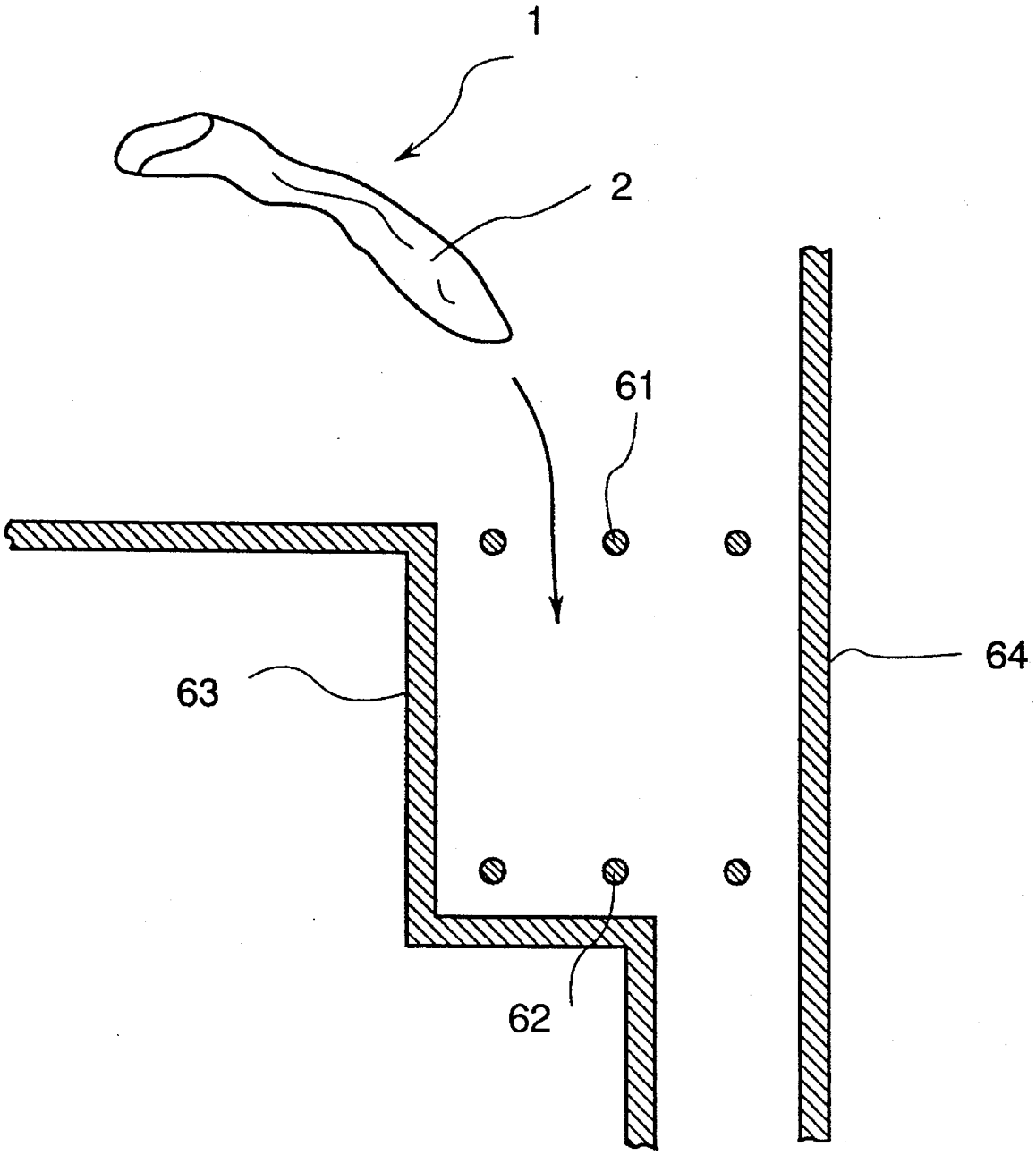
FIG. 4 is a schematic sectional view to explain the steps to use the preferred embodiment.
Figure 5:
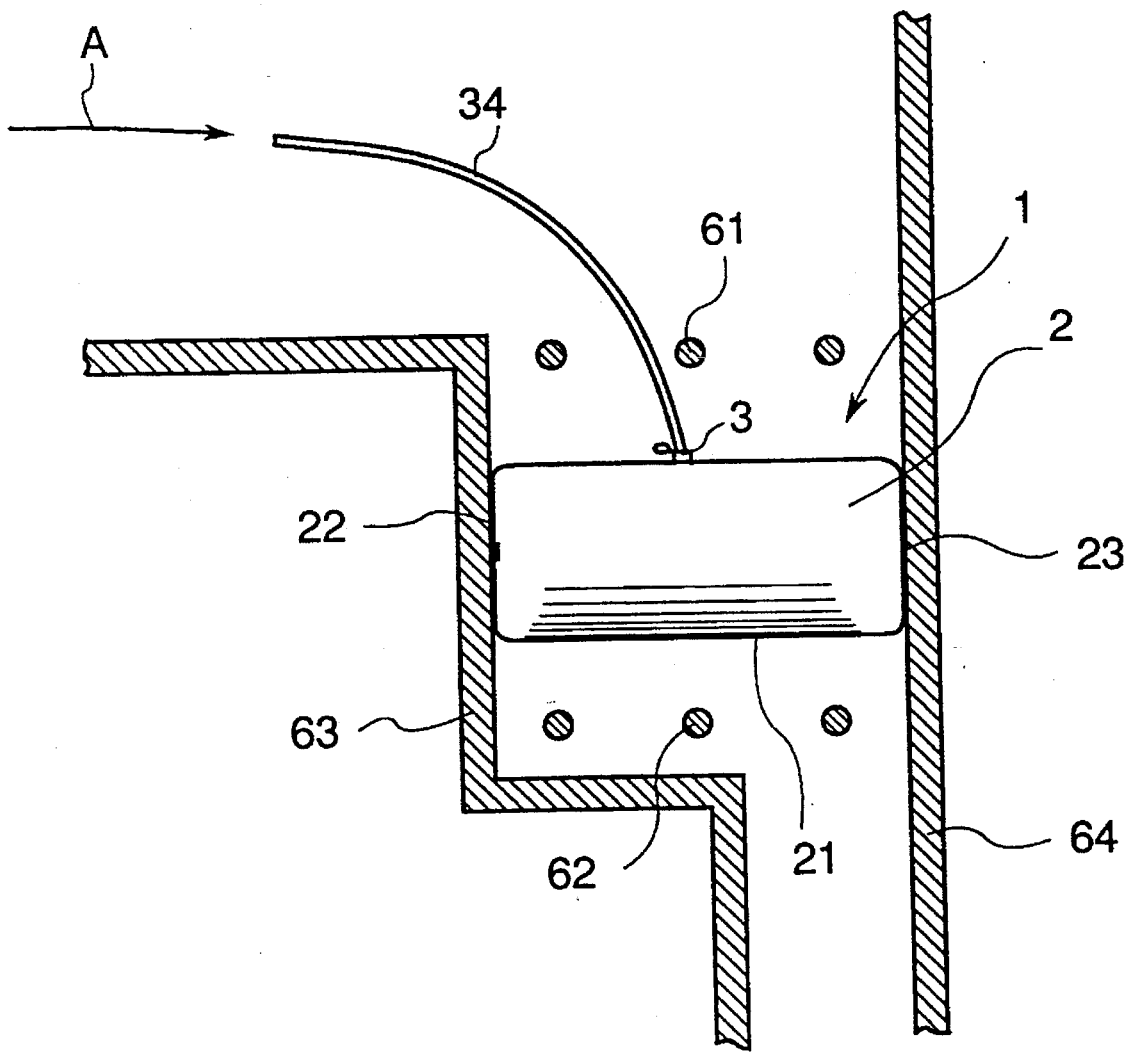
FIG. 5 is a schematic sectional view to explain the steps to use the preferred embodiment.
Figure 6:
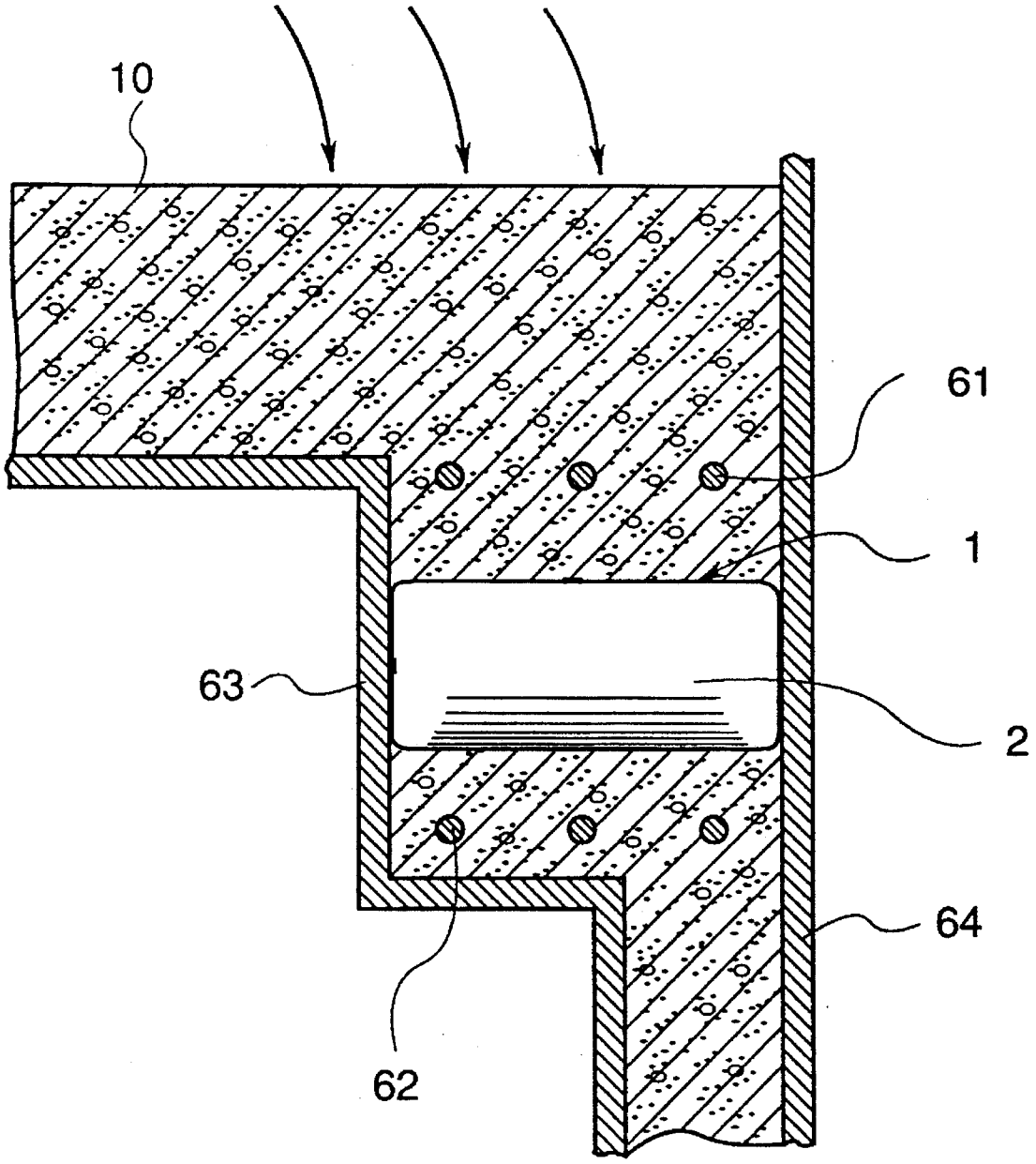
FIG. 6 is a schematic sectional view to explain the steps to use the preferred embodiment.
Figure 7:
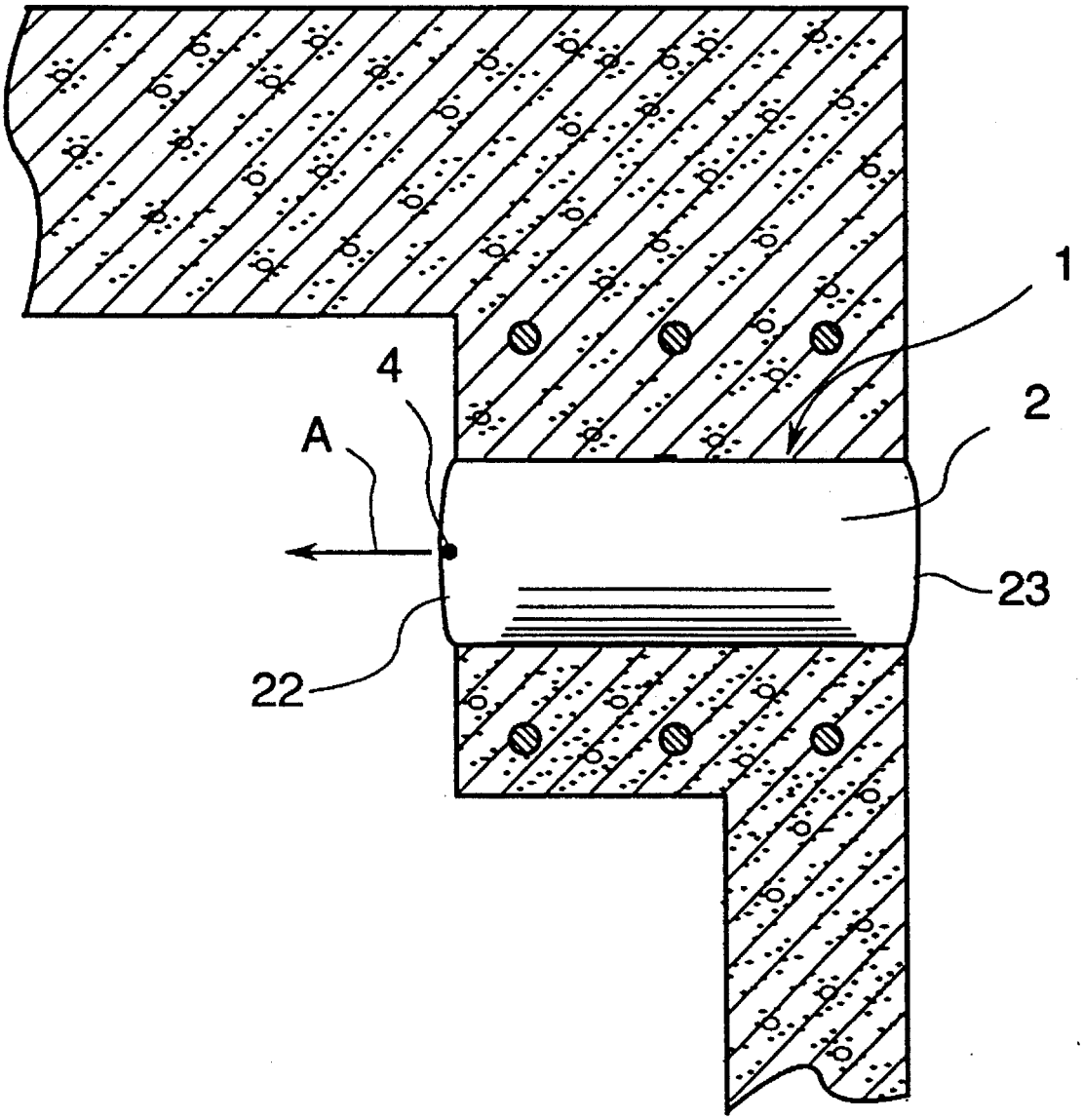
FIG. 7 is a schematic sectional view to explain the steps use the preferred embodiment.
Figure 8:
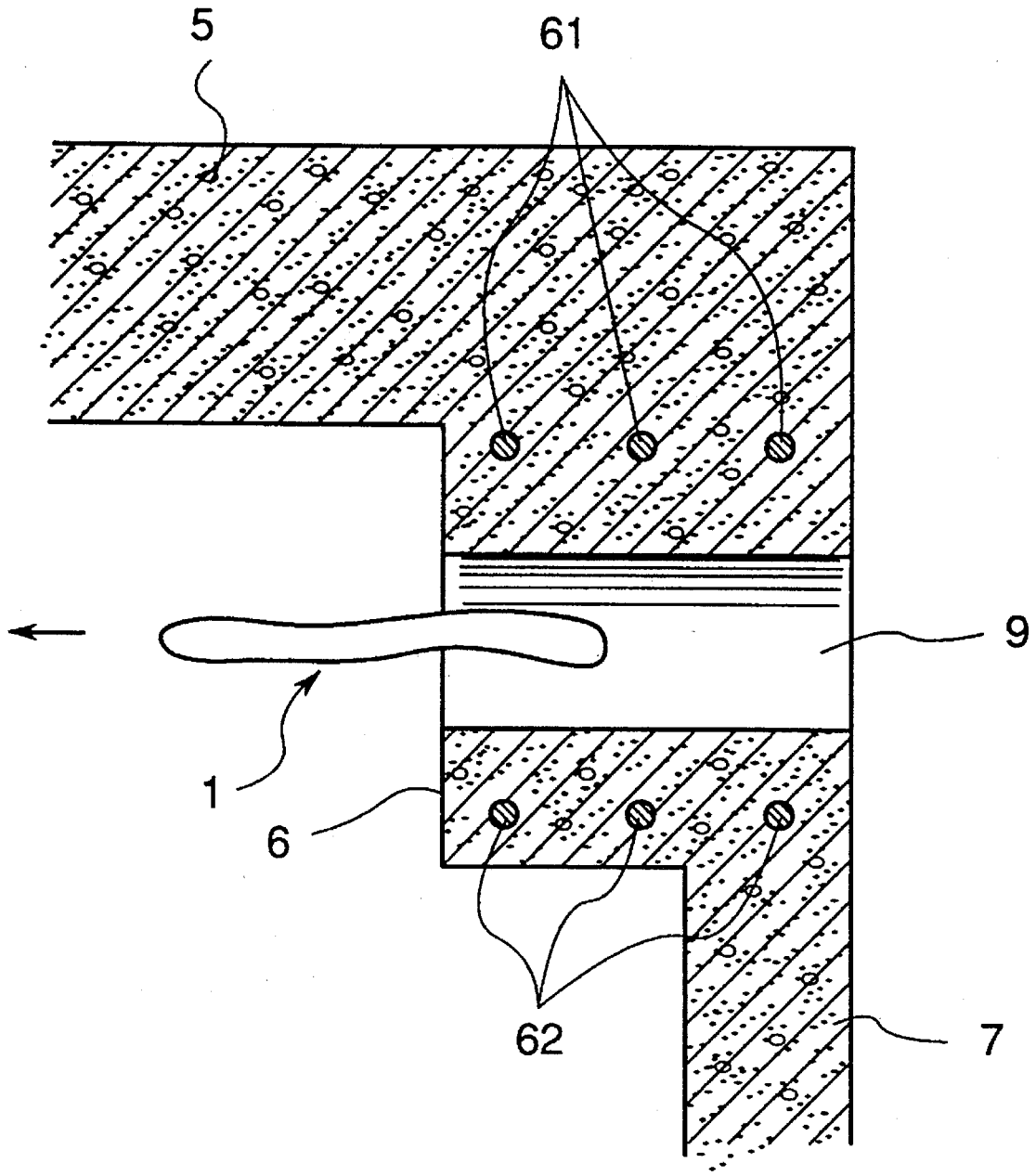
FIG. 8 is a schematic sectional view to explain the steps to use the preferred embodiment.

A method of forming a through hole 9 at the above-mentioned beam 6 will be explained. First, the flexible form member 1 is placed at a predetermined position between an inner form 63 and an outer form 64, with the body 2 kept in a contracted shape to pass through the reinforcements 61 as shown in FIG. 4. Then air A is introduced into the body 2 through the openable fluid introducing and discharging means 3. More particularly, as shown in FIG. 5, a tube 34 is attached to the openable fluid introducing and discharging means 3 which is provided on the circular wall 21 of the flexible form member 1. The body 2 of the flexible form member 1 is expanded by filling air A by means of a mini-compressor or a pair of bellows not shown, so that the body 2 is inflated and interposed between the inner and outer forms 63, 64. In other words, the end wall 22 is tightly in contact with the inner surface of the inner form 63 and also the end wall 23 is thrust against the inner surface of the outer form 64. Under that condition, as shown in FIG. 6, concrete 10 is poured into a space between the inner and the outer forms 63, 64. The inner and outer forms 63, 64 are removed when concrete 10 has cured. Then the surfaces of the flexible form member 1 which have tightly been in contact with the inner and outer forms 63, 64, namely, the outside surfaces of the end walls 22, 23 will be exposed to the surfaces of the concrete structure as shown in FIG. 7. Under this condition, the air A is discharged by opening the openable fluid introducing and discharging means 4 which is provided on the end wall 22 so as to contract the body 2 of the flexible form member 1. Finally, the contracted flexible form member 1 is removed as shown in FIG. 8, thereby the through hole 9 is formed at the predetermined position of the beam 6.

In accordance with the preferred embodiment of the invention, even after the reinforcements 61, 62 have been arranged, the flexible form member 1 can be set at a predetermined position, by passing the body 2 contracted through the narrow gap between reinforcements 61, 62, placing the body 2 contracted at the predetermined position between the inner form 63 and the outer form 64, and then introducing air A into the body 2 through the openable fluid introducing and discharging means 3. This can solve the problems of taking a lot of time and labor to set the flexible form member 1. This also can prevent the through hole 9 from being deformed because of insufficient restoration of the flexible form member after arranged. In accordance with this embodiment, the flexible form member 1 can be set just before concrete is poured so that it can reduce a possibility dramatically that the flexible form member 1 may move from the predetermined position due to unexpected external force applied to the flexible form member, thereby the through hole 9 can be formed at the predetermined position with accuracy. In accordance with the preferred embodiment, in case that the body 2 has hollow cylindrical shape, the length of the body 2 can easily be adjusted on the spot of the construction by shortening the length of the expanded body 2 with one of the end walls 22, 23 of the body 2 squeezed into inside of the body 2 if the distance between the inner and outer forms 63, 64 is shorter than the length of the body 2.

Figure 9:
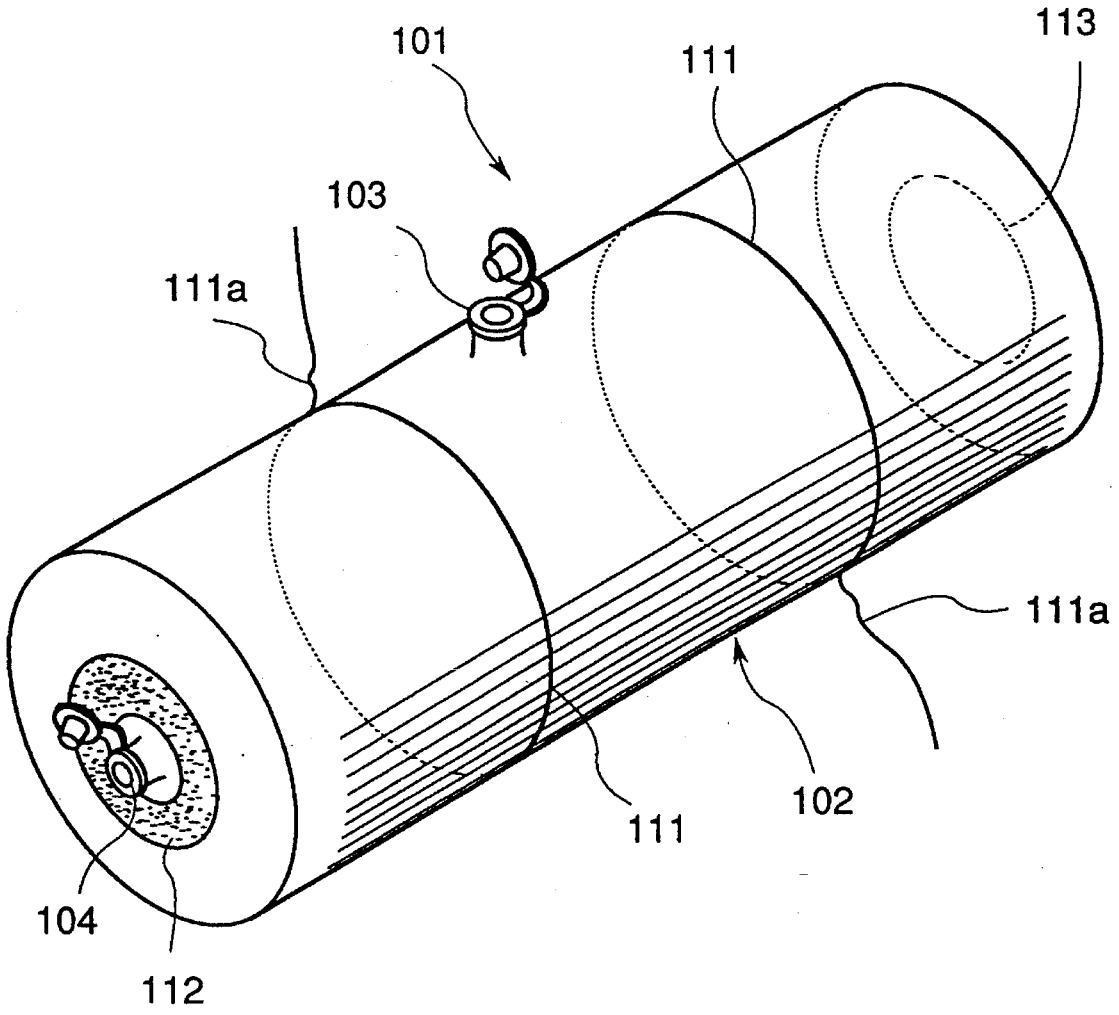
FIG. 9 is a perspective view of another preferred embodiment of the invention.
Figure 10:
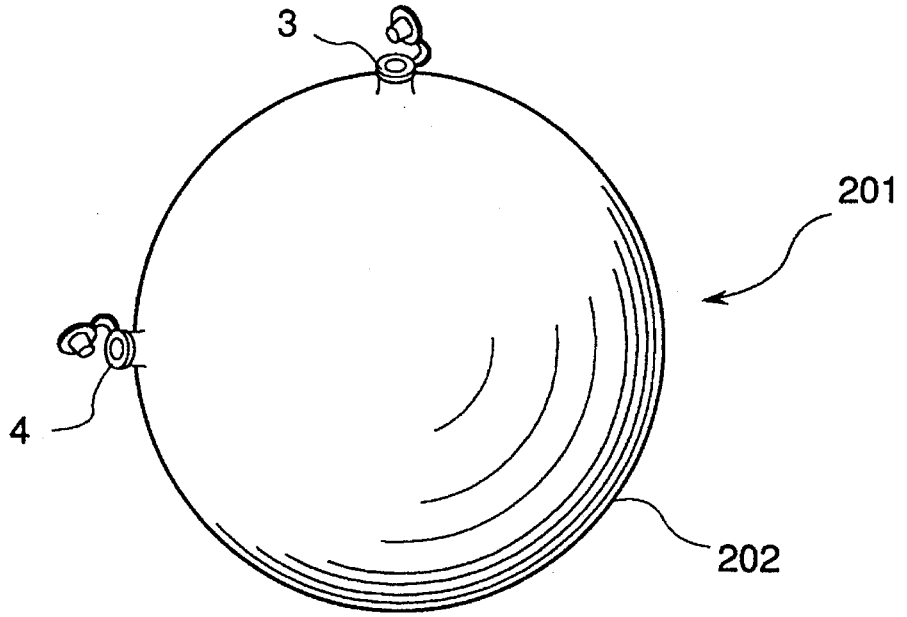
FIG. 10 is a perspective view of a further alternative preferred embodiment of the invention.
Figure 11:
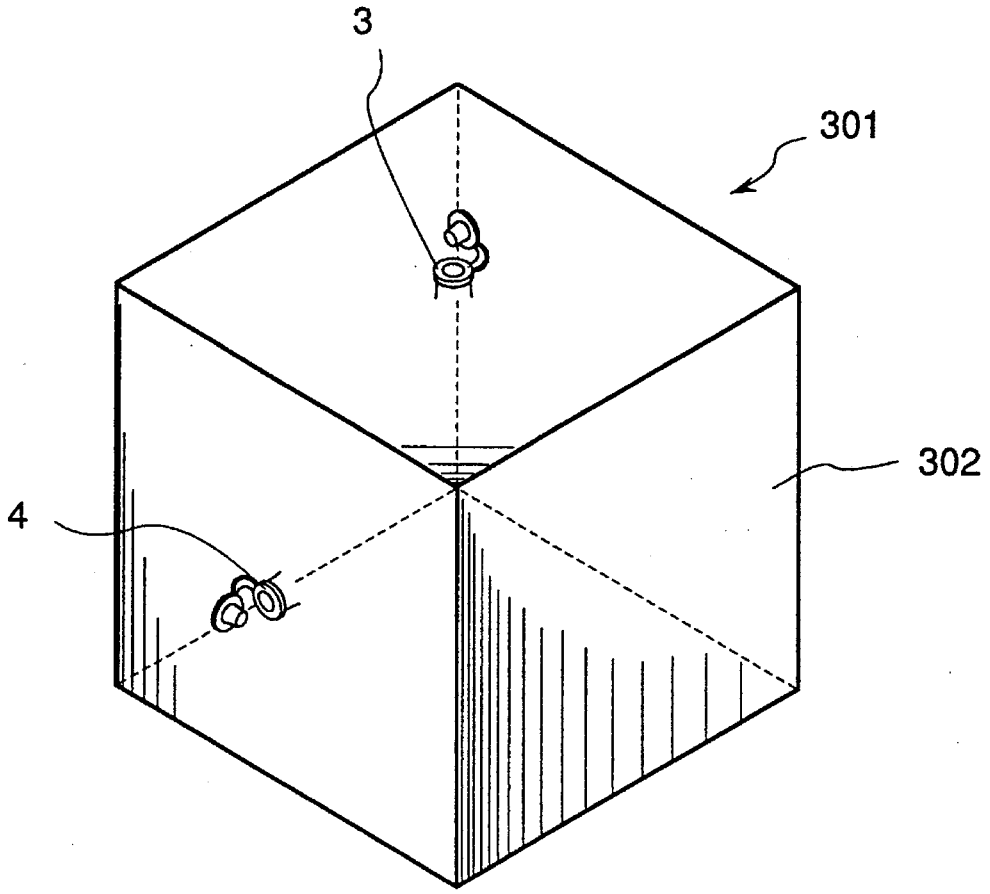
FIG. 11 is a perspective view of a further alternative preferred embodiment of the invention.
Figure 12:
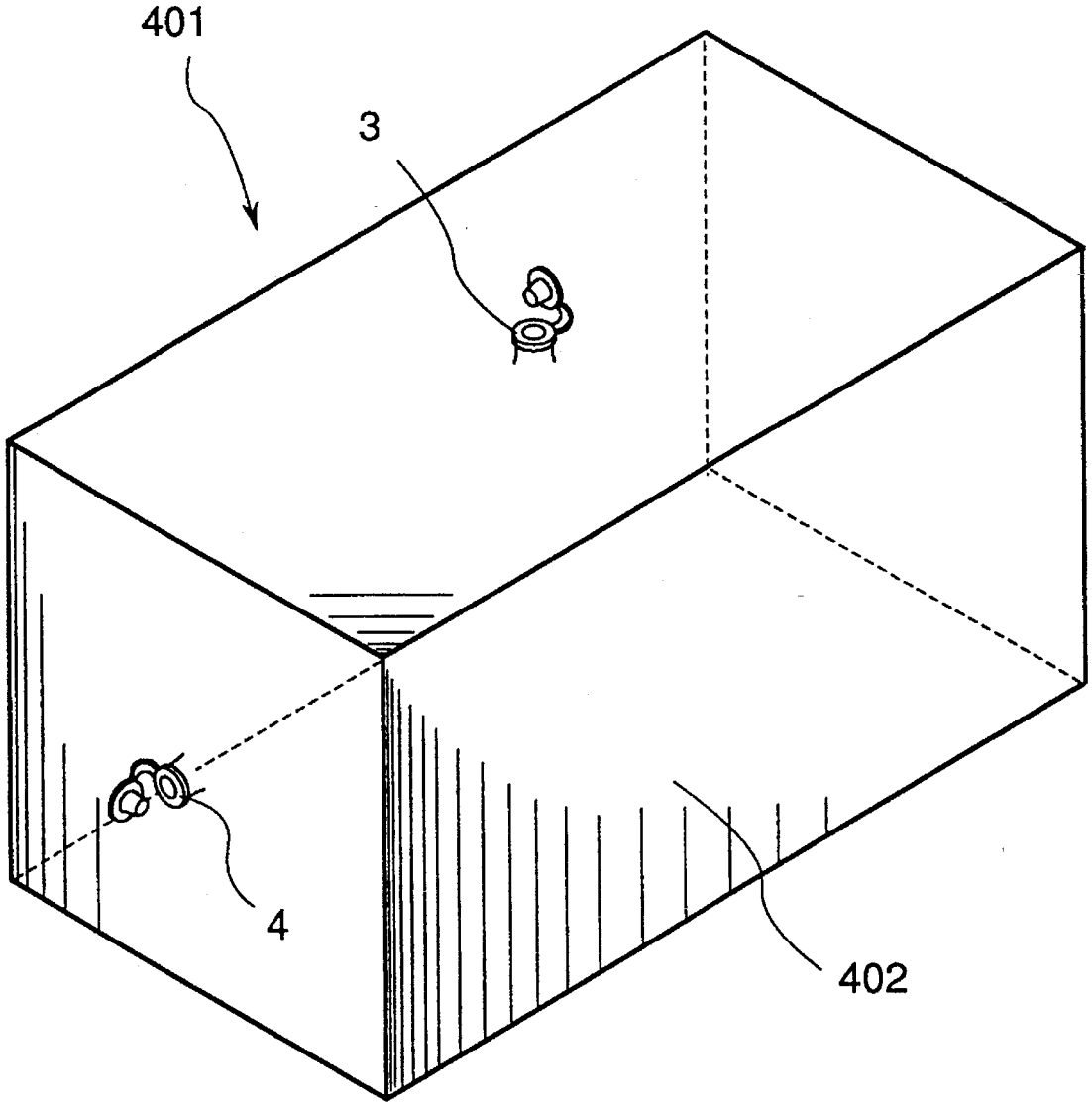
FIG. 12 is a perspective view of a further alternative preferred embodiment of the invention.
Figure 13:
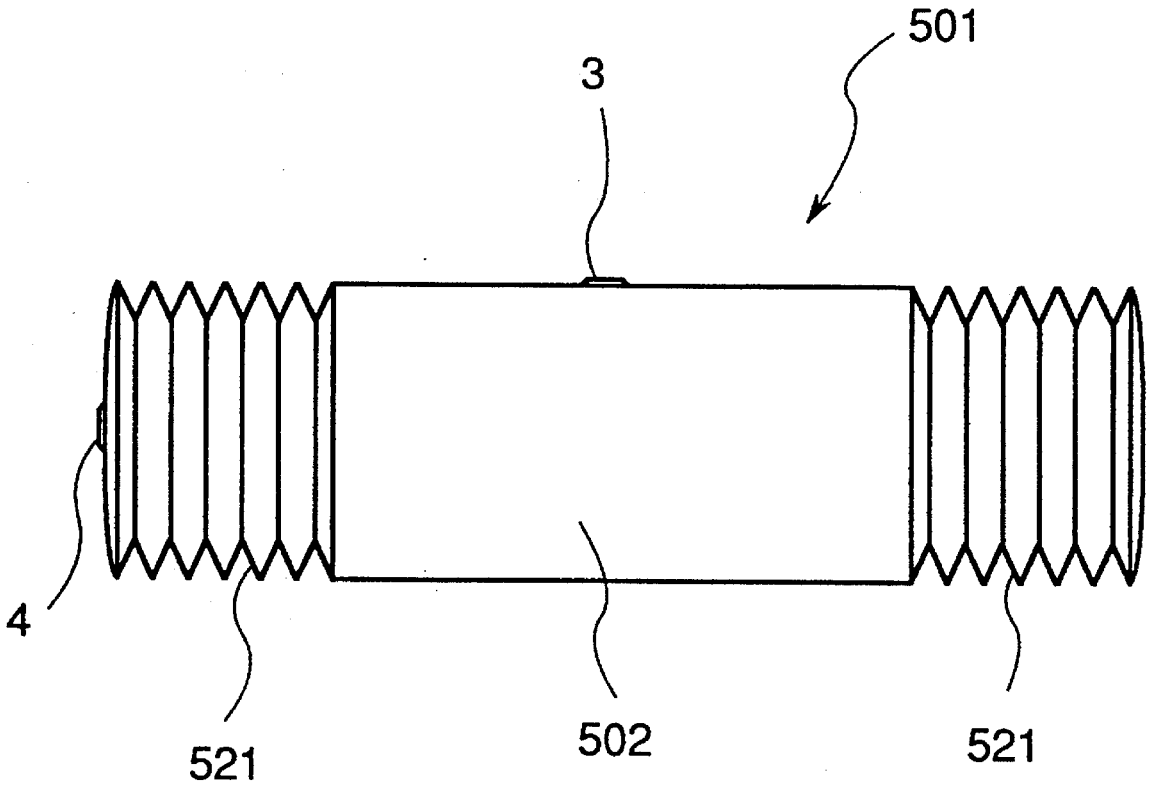
FIG. 13 is a perspective view of a further alternative preferred embodiment of the invention.

In accordance with the preferred embodiment of the invention, the flexible form member is not limited to the above-mentioned structure, namely, comprising the body and the openable fluid introducing and discharging means 3, 4 but may be as shown in FIG. 9. More particularly, a flexible form member 101 shown in FIG. 9 comprises not only a body 102, and an openable fluid introducing and discharging means 103, 104 but also a strengthening string 111 wrapped around the circumference of the body 102 and adhesive parts 112, 113 provided at end walls of the body 102. The strengthening string 111 enables higher pressurized fluid to be introduced into the body 102 and is good for retaining the shape of the body 102. The strengthening string 111 effectively prevents the center part of the body 102 from moving or deforming if one end 111*a* of the strengthening string 111 is structured to extend from the body 102 and tied to a reinforcement or the like. The adhesive parts 112, 113 are formed by applying glue such as Bond to the end wall of the body 102 and protected by a release paper or the like when not in use. With the adhesive parts 112, 113 provided at the end walls of the body 102, the end wall of the body 102 will adhere to the inner surface of the inner form 63 and the outer form 64 when the body 102 is expanded. It is useful to prevent the flexible form member 101 from changing the position relative to the inner form 63 and the outer form 64.

The body is not limited to a cylinder in shape, it may be, for example, any shape as shown in FIG. 10 through FIG. 13. More particularly, a flexible form member 201 shown in FIG. 10 comprises a spherical body 202, which can be utilized for forming a hole whose medium portion is of a large diameter. A flexible form member 301 shown in FIG. 11 comprises a cubic body 302, which can be utilized for forming a hole rectangle in section in which the length of the hole and the height of the opening are generally the same. A flexible form member 401 shown in FIG. 12 comprises a rectangular parallelepiped body 402, which can be utilized for forming a hole rectangular in section. A flexible form member 501 shown in FIG. 13 has a flexibly expandable and contractible bellow part 521 provided at both ends of the body 502. In accordance with the above-mentioned structure, the flexible form member can be used for forming holes of various lengths with ease, thereby to dispense with the complicated process of making preparation for various form members different in length. The openable fluid introducing and discharging means provided on the body is not limited in shape to the above-mentioned embodiment but may be a long tube which extends from the body.

Figure 14:
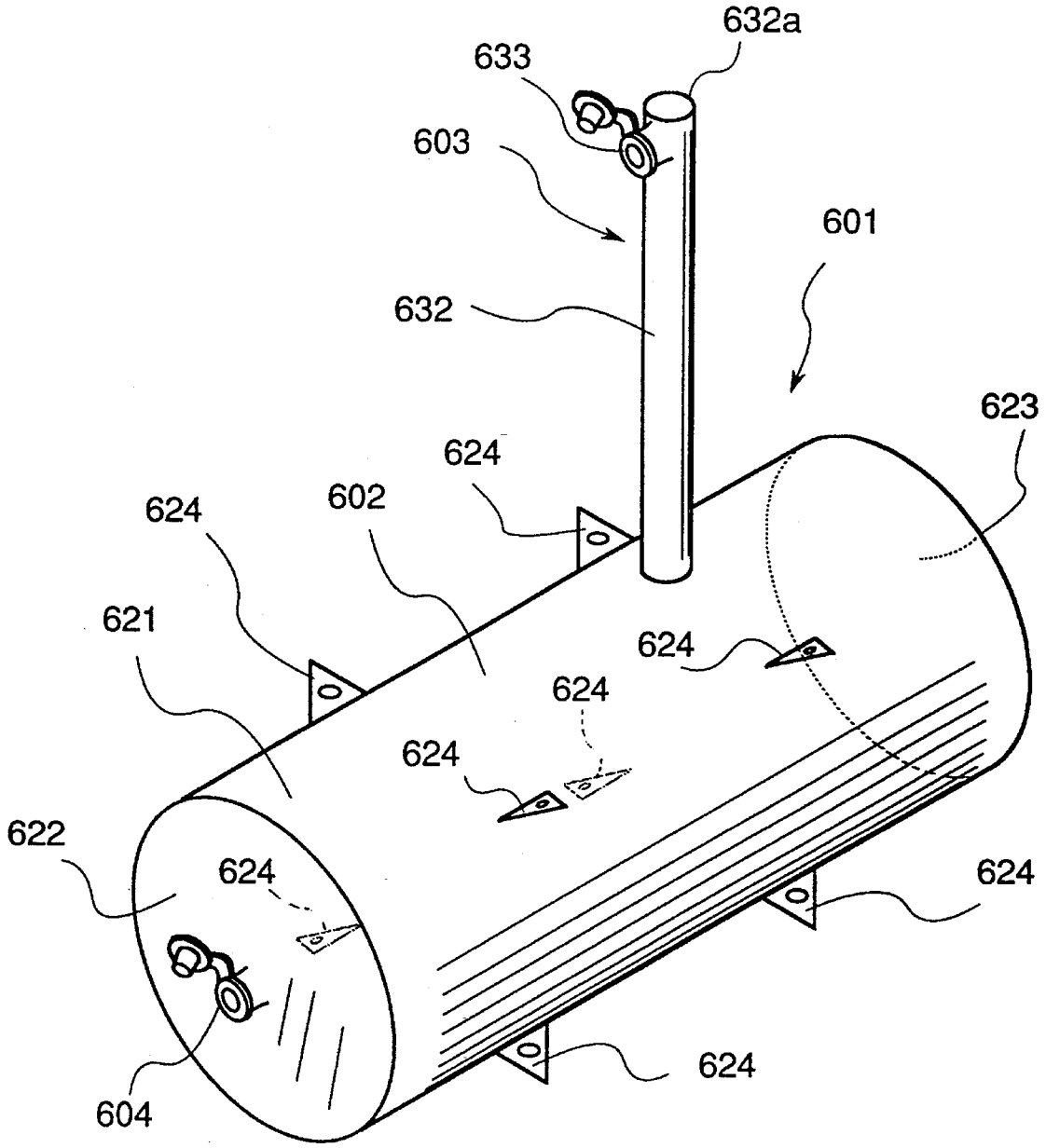
FIG. 14 is a perspective view of a further alternative preferred embodiment of the invention.

More particularly, as shown in FIG. 14, an openable fluid introducing and discharging means 603 of the flexible form member 601 extends from a circular wall 621 which constitutes a flexible hollow body 602 and comprises a long tubular passage part 632 having a check valve 631 at the side of the body 602 and a cap member 633 which is attached to one end 632*a* of the passage part 632 and openable. The passage part 632 is made of the same material as that of the body 602, about four fifths of the body 602 in length, and can be elastically transformed. This makes it easy to connect an air pump or the like to the passage part 632 even though the reinforcements 61 are arranged in a relatively crowded pitch, as the passage part 632 can stretch out through the space between reinforcements 61 to the outside of the reinforcements 61 with ease. The body 602 has a collapsible connecting part 624 on the circular wall 621 of the body 602 for making it easier to secure the body 602 to the reinforcements 61. The connecting part 624 comprises a triangle flat plate with a circle aperture. A wire 608 as a fixing member is wound around the circle aperture, and then another end of the wire 608 is wound around the reinforcement 61, thereby to fix the flexible form member 601. An openable fluid introducing and discharging means 604 having the same structure as the above-mentioned embodiment is provided on at least one of the end walls 622, 623 through which the body 602 can be contracted when removing the flexible form member 601 out of the cured concrete.

Figure 15:
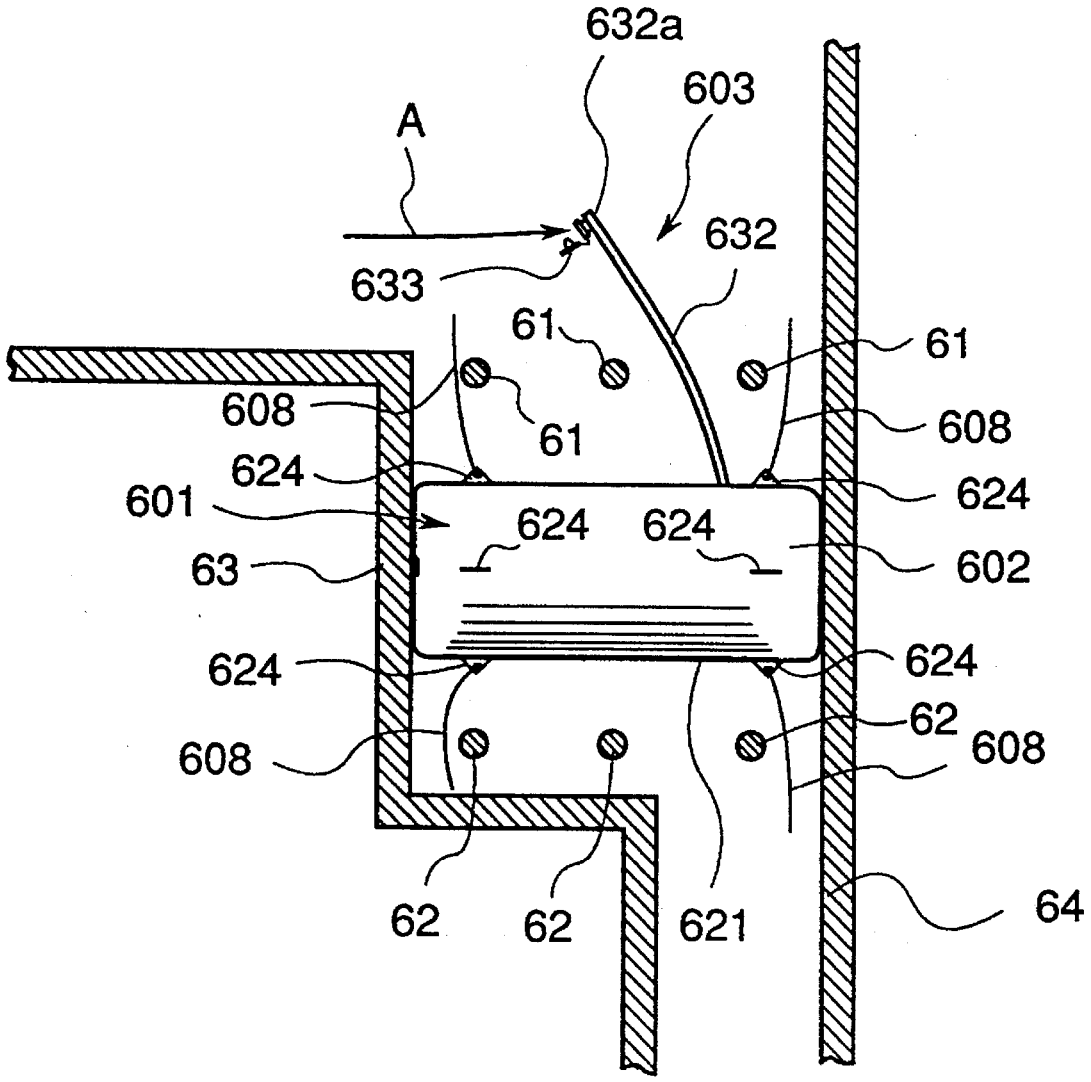
FIG. 15 is a schematic sectional view to explain the steps to use the embodiment shown in FIG. 14.
Figure 16:
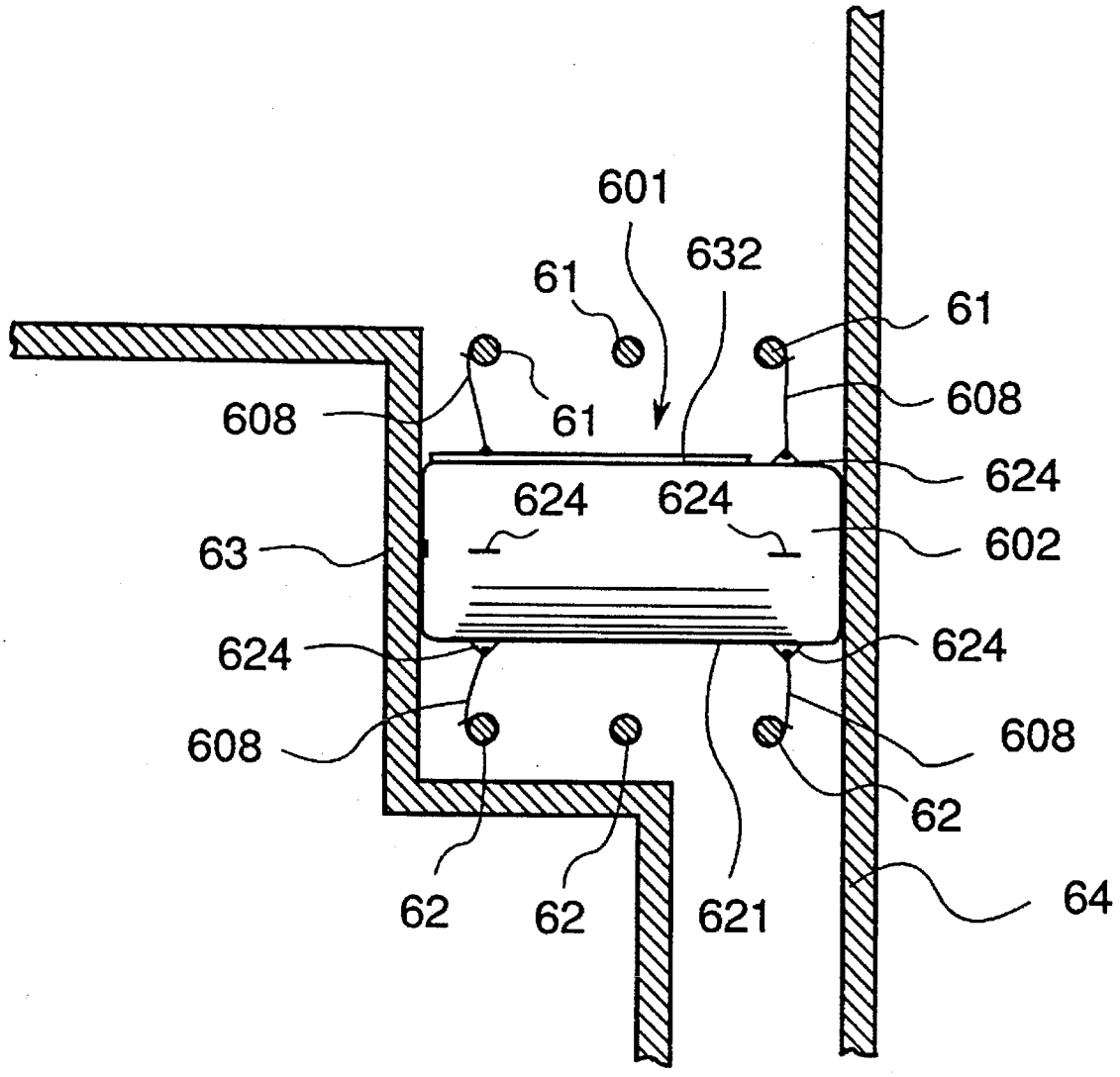
FIG. 16 is a schematic sectional view to explain the steps to use the embodiment shown in FIG. 14.

The flexible form member 601 is used as the same as the above-mentioned embodiment, namely, to be arranged at a predetermined position between an inner form 63 and an outer form 64 in a contracted shape with most of the fluid discharged out of the body 602 and to be kept at the position. At this time a wire 608 is wound around each connecting part 624 to make preparation for speeding up later process of securing the body 602. As shown in FIG. 15, the passage part 632 is made to stretch out toward a direction at which an air pump can easily be connected and fluid is introduced into the body 602 through the passage part 632. As the body 602 is expanded to a predetermined size by the fluid, each of the wire 608 is fixed to each reinforcement 61 by winding around the reinforcement 61 and the passage part 632 with the cap member 633 closed is tightly attached to the body 602 and then fixed to the body 602 by means of an adhesive tape as shown in FIG. 16. Further steps are omitted to explain as being the same as the steps (shown through FIG. 6 to FIG. 8) for the above-mentioned embodiment. In accordance with the embodiment, since the flexible form member 601 is secured to the reinforcements 61 with the connecting part 624 connected to the reinforcements 61 by means of the wire 608, the flexible form member 601 is structured not to change the position where it should be even though various force is applied when concrete is poured. The flexible form member 601 having such a long openable fluid introducing and discharging means 603 is not limited to comprising a cylindrical body but may be comprising a body whose shape varies as above-mentioned.

The material of the body is not limited to vinyl chloride, but may be, for example, polyethylene, rubber or other similar material having a property of flexibility. The quality of the material do not preferably harden at a low temperature and is difficult to be soft at a high temperature. The low and the high temperatures mean approximate the lowest and the highest temperatures on the spot of construction.

The fluid to be introduced into the body is not limited to air but may be other gas.

In addition, each of the above-mentioned embodiment employs the openable fluid introducing and discharging means having a check valve, but the check valve can be omitted if the passage part is long enough to be pinched by a finger. More particularly, the openable fluid introducing and discharging means may be so structured that the passage part can be pinched by a finger until a cap member is closed so as not to discharge the fluid out of the body after the fluid has finished to be introduced. Such a structure without a check valve contributes to make it easy to discharge the fluid. A passage part may be so structured to be buried into a body after a cap member is closed.

In the above-mentioned embodiments the flexible form member is directly arranged in a space between the reinforcements. The flexible form member may be covered at least the part which contacts the concrete with a cover made from the flexible sheet.

Figure 17:
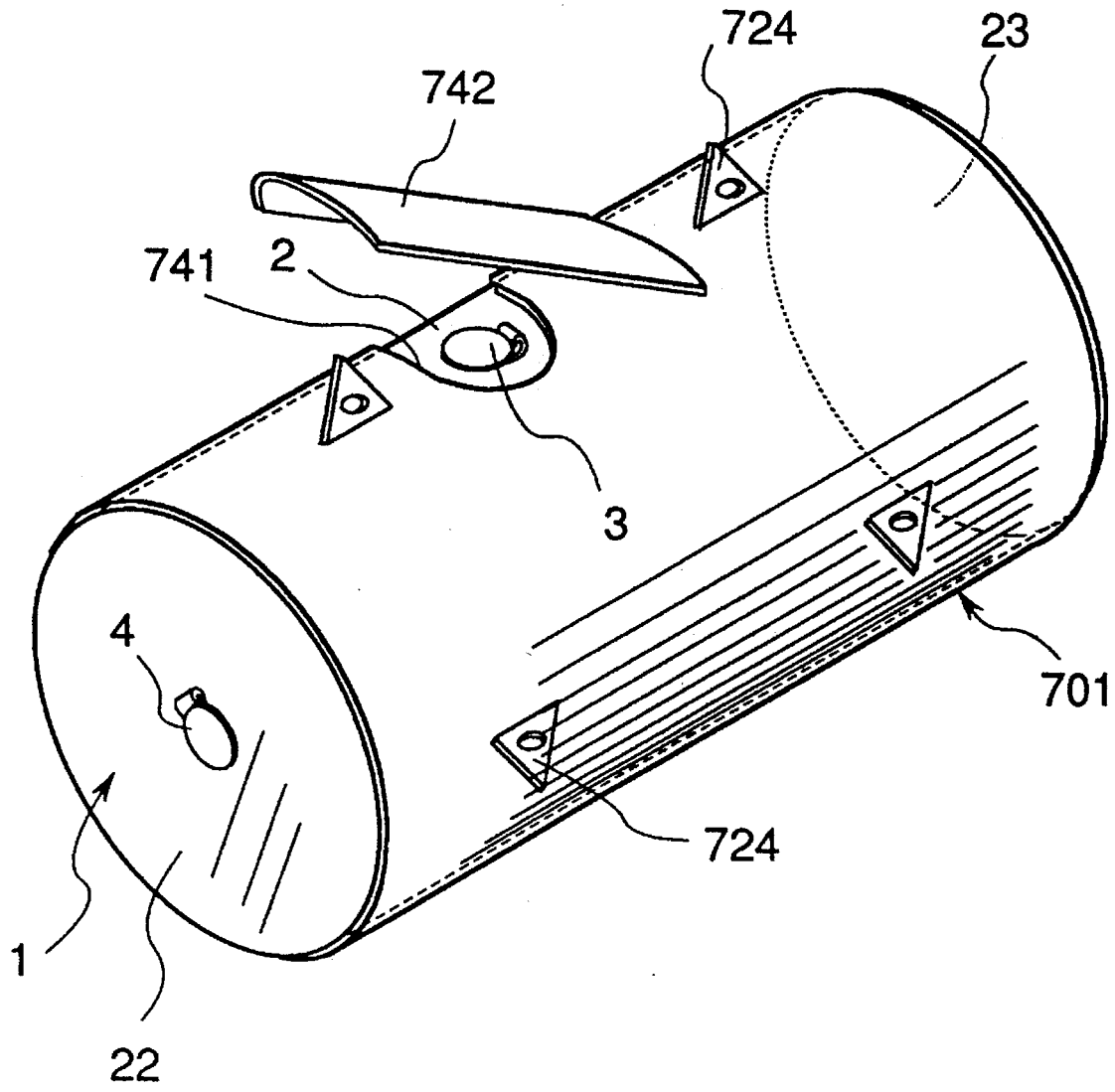
FIG. 17 is a perspective view of the flexible form member of the first preferred embodiment covered with a cover body.
Figure 18:
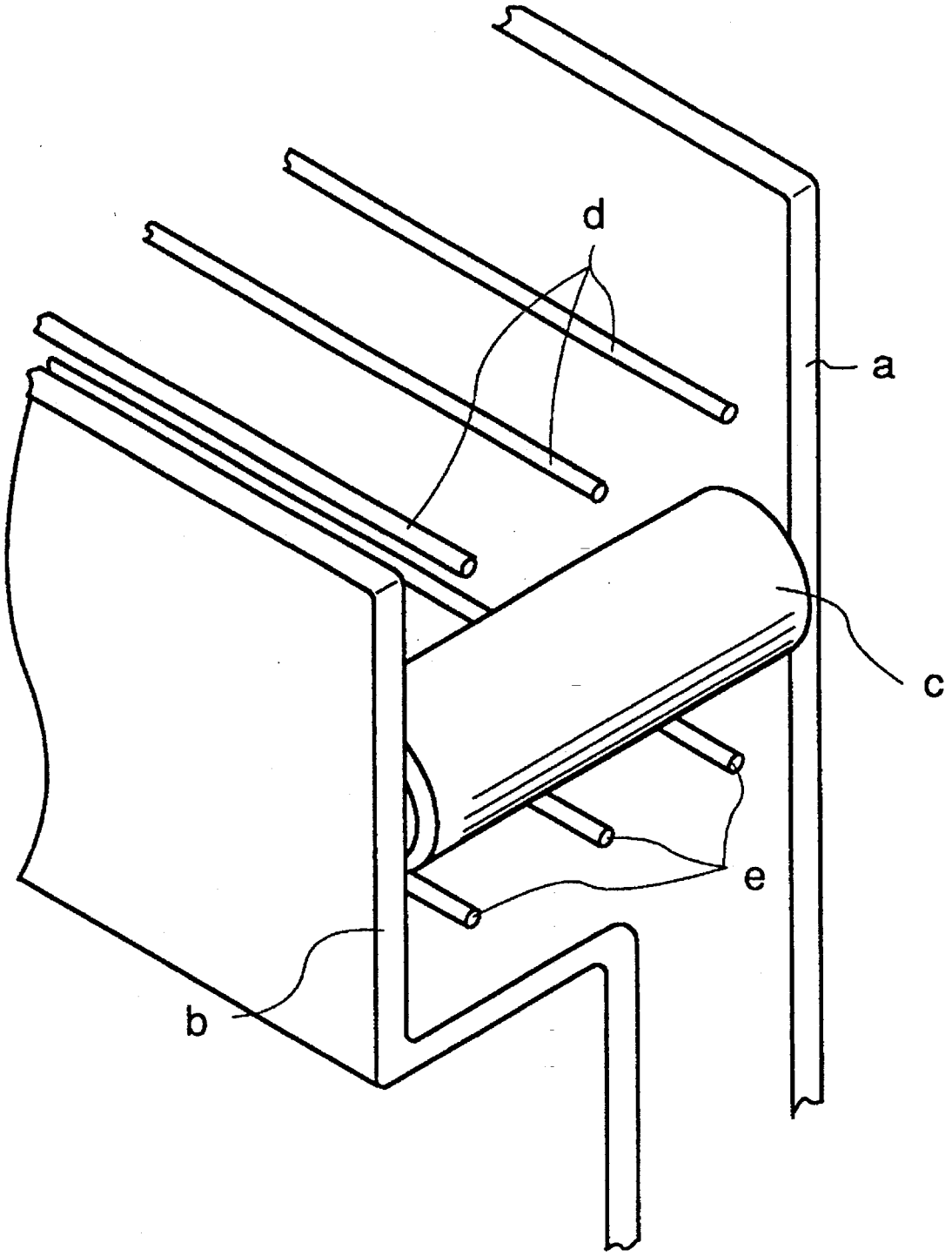
FIG. 18 is a perspective view to explain a prior art.

A cylindrical cover 701 whose length is almost the same as the form members 1, 601 and whose diameter is almost the same as the outside diameter of the expanded form members 1, 601 is preferably applied to the flexible form members 1, 601 shown in FIGS. 1 and 14. The cover is preferably made of the material having a characteristics of less flexible than that of the flexible form members 1, 601, namely, hard to distend with pressurized air when in use. The cover is cylinder in shape to fit the outward shape of the expanded flexible form members 1, 601. In case of the embodiments shown in FIGS. 11 and 12, the cover is prism in shape. As shown in FIG. 17, several connecting parts 724 are provided on the outside surface of the cover 701 like the flexible form member 601. An aperture 741 is also provided at the part corresponding to the openable fluid introducing and discharging means 3 on the outside surface of the cover 701 to allow the openable fluid introducing and discharging means 3 to extend to out of the cover 701. The aperture 741 can be closed by means of the lid 742 provided on the outside of the aperture 741 and integrated with the cover 701 after air has been introduced.

The flexible form member 1 employing the cover 701 is used with the following steps; to insert the flexible form member 1 contracted into the cover 701, to place to position the cover 701 and the flexible form member 1 at the position to be arranged, then to introduce air to the flexible form member 1. The steps are the same as the above-mentioned embodiments except for the step to insert the flexible form member 1 contracted into the cover 701. The cover 701 is pasted up on the inside surface of the through hole 9 formed in the concrete and the flexible form member 1 can easily be removed from the through hole 9 in a contracted condition like the above-mentioned embodiments when the flexible form member 1 is contracted after concrete has cured. Thus the flexible form member 1 does not contact with concrete, thereby to prevent the flexible form member 1 from becoming dirty even after used. In addition, the cover 701 contributes to improve the life of the flexible form member 1. Since the cover 701 covers the outside of the flexible form member 1, the cover 701 improves the entire strength of the form member and prevents the flexible form member 1 from being deformed when in use, thereby to form the through hole 9 with accuracy.

The above-mentioned flexible form members 1, 201, 301, 401, 501, 601 and the cover 701 are preferably colored in a color which can easily be distinguished on the spot of the construction. Form members colored in a totally different color from the reinforcement and other form members make it easy to confirm the position at which the flexible form members have been arranged, thereby to decrease the total numbers of process required to arrange the flexible form members.

There may be various modifications without departing from the spirit and essential characteristics thereof.

POSSIBLE APPLICATIONS IN INDUSTRY

In accordance with the invention, the flexible form member and the method of forming a through hole by means of the form member is useful because the flexible form member can be set at a predetermined position between the forms with ease even after reinforcements have been arranged, thereby to form a through hole at the predetermined position. Moreover, the through hole can be formed accurately without changing the position where it should be.

What is claimed is:

1. A flexible form member comprising; a hollow-shaped flexible body having an openable fluid introducing and discharging means for permitting fluid to be introduced into and discharged from the body, and a detachable cover, said cover having an outer surface and a plurality of connecting elements on its outer surface to connect a fixing member for securing itself.

2. The flexible form member as defined in claim 1, wherein said openable fluid introducing and discharging means comprises a tubular passage part which is connected to said body and a cap member which is attached to an outside end of said passage part and able to open.

3. The flexible form member as defined in claim 2, wherein said passage part has a check valve at a body side end thereof.

4. The flexible form member as defined in claim 1, wherein said body comprises a circular wall being cylindrical and an end wall fixed integrally and airtightly on each of ends of said circular wall, and the openable fluid introducing and discharging means is provided on at least the circular wall and one of the end walls.

5. The flexible form member as defined in claim 2, wherein said body comprises a circular wall being cylindrical and an end wall fixed integrally and airtightly on each of ends of said circular wall, and the openable fluid introducing and discharging means is provided on at least the circular wall and one of the end walls.

6. A method of forming a through hole by means of a flexible form member comprising steps of;

placing a flexible form member at a predetermined position between an outer form and an inner form which are for shutting concrete flow off, the flexible form member comprising a hollow-shaped flexible body having an openable fluid introducing and discharging means for permitting fluid to be introduced into and discharged from the body, and a detachable cover, said cover having an outer surface and a plurality of connecting elements on its outer surface to connect a fixing member for securing itself, and being contracted by discharging fluid from the body, placing the contracted flexible form member within the detachable cover, introducing the fluid into the body of the flexible form member through the openable fluid introducing and discharging means, interposing the flexible form member between the inner form and outer form by expanding the body, pouring concrete into a space between the outer form and the inner form, removing the inner and outer forms after the curing of concrete, discharging the fluid out of the body through the openable fluid introducing and discharging means so as to contract the flexible form member, and removing the flexible form member out of the detachable cover and the cured concrete.

7. The method of forming a through hole as defined in claim 6, wherein said body comprises a circular wall being cylindrical and an end wall fixed integrally and airtightly on each of ends of said circular wall, and the openable fluid introducing and discharging means is provided on the circular wall and one of the end walls.

8. The method of forming a through hole as defined in claim 6, wherein said openable fluid introducing and discharging means comprises a tubular passage part which is connected to the body and a cap member which is attached to an outside end of said passage part and able to open.

9. The method of forming a through hole as defined in claim 8, wherein said passage part has a check valve at its end of the body side.

10. A flexible form member comprising: a hollow-shaped flexible body having an openable fluid introducing and discharging means for permitting fluid to be introduced into and discharged from the body and further comprising a detachable cover which covers the body.

* * * * *